United States Patent [19]

Partain

[11] 4,151,947

[45] May 1, 1979

[54] ACCESS DOOR FOR STORAGE OR WARDROBE CONTAINER

[75] Inventor: James H. Partain, Norcross, Ga.

[73] Assignee: Stone Container Corporation, Chicago, Ill.

[21] Appl. No.: 871,375

[22] Filed: Jan. 23, 1978

Related U.S. Application Data

[63] Continuation-in-part of Ser. No. 807,383, Jun. 17, 1977, Pat. No. 4,111,300.

[51] Int. Cl.[2] ..... B65D 85/18

[52] U.S. Cl. ..... 229/17 R; 206/278; 206/290; 229/37 R

[58] Field of Search ..... 229/17 R, 37 R; 206/290, 289

[56] References Cited

U.S. PATENT DOCUMENTS

| | | | |
|---|---|---|---|
| 1,585,494 | 5/1926 | Harvey | 229/17 R |
| 2,807,354 | 9/1957 | Belsinger | 206/290 |
| 2,822,093 | 2/1958 | Graci | 206/290 X |
| 3,074,538 | 1/1963 | Belsinger | 206/290 |
| 3,262,631 | 7/1966 | Belsinger | 229/37 R |
| 3,294,221 | 12/1966 | Notro et al. | 206/289 |
| 3,369,652 | 2/1968 | Bebout | 206/290 X |
| 3,493,101 | 2/1970 | Collin | 206/290 |
| 3,866,750 | 2/1975 | Collin | 229/17 R X |

FOREIGN PATENT DOCUMENTS

| | | | |
|---|---|---|---|
| 639794 | 4/1962 | Canada | 206/290 |
| 857720 | 1/1961 | United Kingdom | 206/290 |

*Primary Examiner*—Davis T. Moorhead

*Attorney, Agent, or Firm*—Silverman, Cass & Singer, Ltd.

[57] ABSTRACT

A wardrobe or storage container formed from an integral paperboard blank having a pair of side walls, a pair of end walls and a bottom wall joined together to form a container body opening at its upper end. One of the side or end walls includes an access door for access into the interior of the completed container. Several embodiments of access door means are disclosed, each of which includes a door jamb and door stop secured together forming a frame to provide support for said access door when said door is closed.

11 Claims, 7 Drawing Figures

ACCESS DOOR FOR STORAGE OR WARDROBE CONTAINER

CROSS REFERENCE TO RELATED APPLICATION

This is a continuation-in-part of application Ser. No. 807,383 filed June 17, 1977 entitled "Paperboard Wardrobe Container", now U.S. Pat. 4,111,300, issued on Sept. 9, 1978.

BACKGROUND OF THE INVENTION

This invention relates generally to wardrobe or storage containers, and more particularly, to novel access door means for providing access into the interior of the containers, said means including a built-in access door frame.

Wardrobe or storage containers formed from integral paperboard blanks are well known as economical, lightweight and durable structures. The upper end of the container body is generally designed to support a conventional hanger bar spanned between opposite walls of the container body so that articles of clothing on clothes hangers can be supported from the span of the hanger bar in the interior of the container body.

The herein invention achieves its objectives utilizing special cuts in the body for access into the container. Advantageous economies in fabrication of the container are realized along with a more desirable, more efficient, partial or full access door in an end or side wall having a built-in frame, jamb and attached top end flap which completes the closure of the top of the container in cooperation with another top end flap.

SUMMARY OF THE INVENTION

A wardrobe container formed from a one-piece prescored foldable blank which includes at least two side walls, two end walls, a bottom wall and two top end flaps connected together. One of the side or end walls includes an access door or panel hingedly connected to the said wall or to an adjacent wall. The access door is formed from a portion of the said wall and the container includes a built-in jamb and door stop to form a built-in frame for the door.

DESCRIPTION OF THE PREFERRED EMBODIMENT

Figure 1:
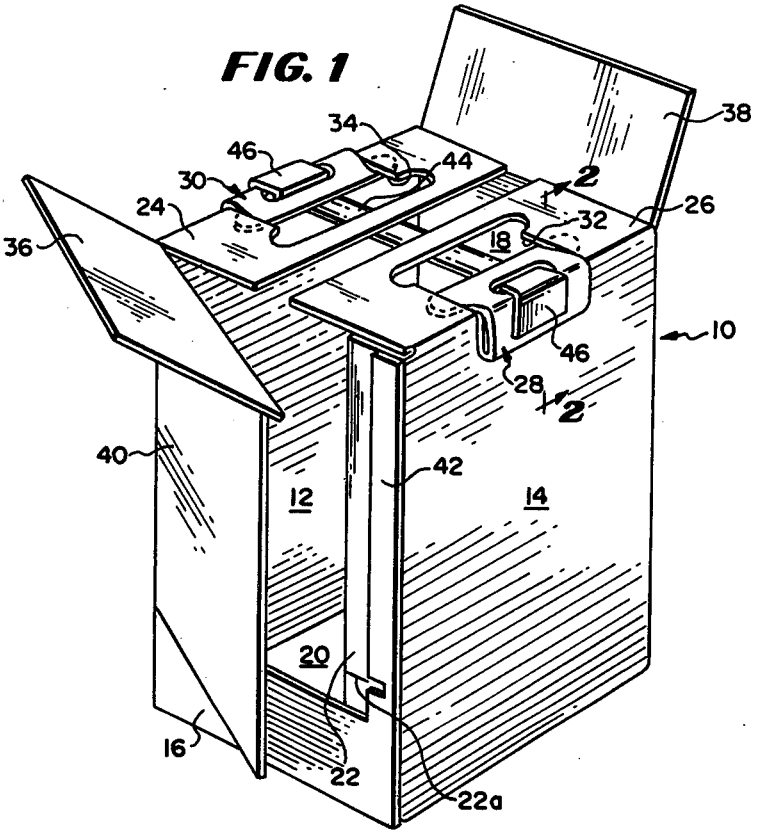
FIG. 1 is a perspective view of a container embodying access door means of the invention partially assembled, with one embodiment of the access door partially opened.

Referring to FIG. 1, there is illustrated a wardrobe or storage container designated generally by the reference character 10 embodying one form of access door means. The container 10 can be erected from integral blanks die-cut from sheeting of paperboard, either corrugated or otherwise, or from other like material by conventional automatic machinery. The container 10 includes two side walls 12 and 14, two end walls 16 and 18 and a bottom wall 20 which are conjoined along lines of fold. The side wall 14 has an extension providing a hinged panel 22 which abutts a portion of end wall 16 and which may be assembled thereto with adhesive or other suitable fastening means.

Figure 2:
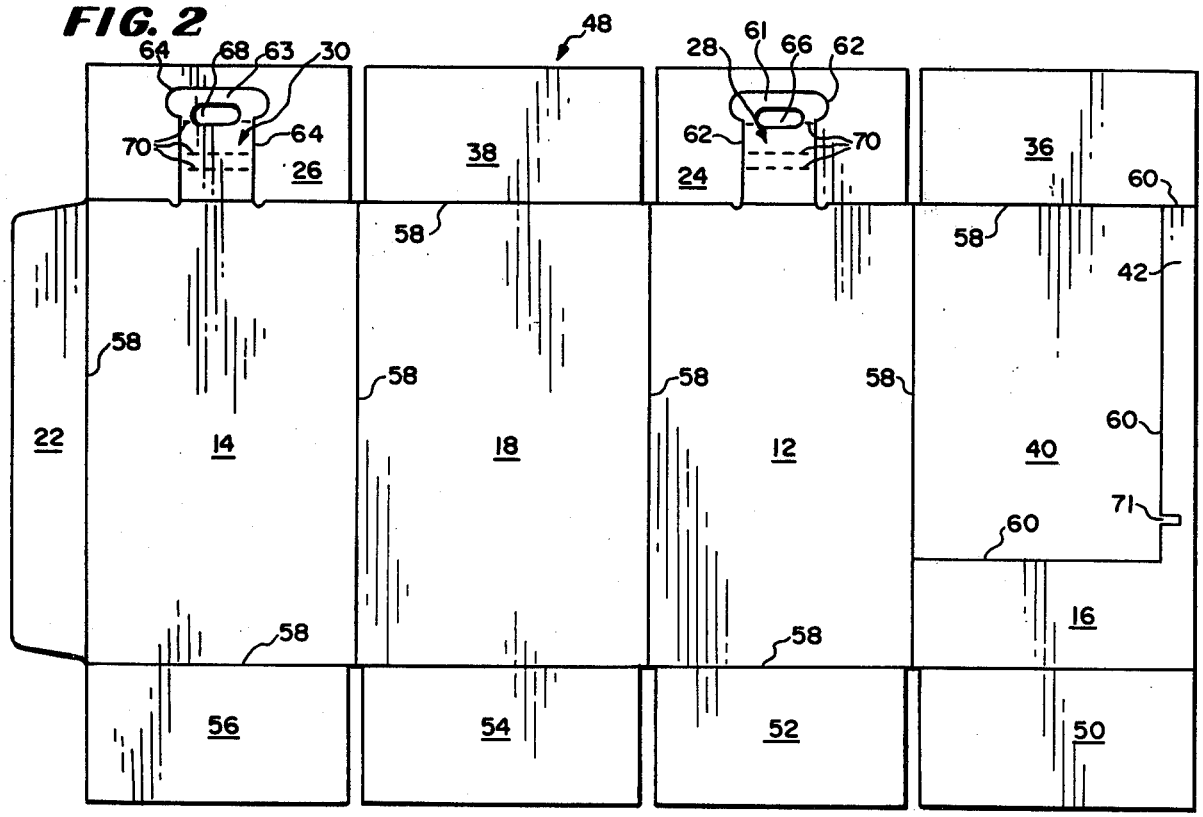
FIG. 2 is a plan view of a carton blank from which the container of FIG. 1 can be erected.

A first pair of end flaps 24 and 26 is hingedly connected to the upper edges of side walls 12 and 14 respectively. Each of the end flaps 24 and 26 may include hanger bar support assemblage or means 28 and 30, partially severable therefrom, as seen in FIG. 2, which are foldable to a position displaced from the plane of the end flaps, leaving the cut outs 32 and 34 seen in FIG. 1. Said means 28 and 30 each are shown engaged against an associated side wall along the exterior surface of the side wall.

A second pair of top end flaps 36 and 38 is provided, adapted to be folded over the first pair of end flaps 24 and 26. The top end flap 36 is hingedly connected to a first access door or panel 40. The access panel 40 is hingedly connected to the side wall 12 and terminates above the bottom portion of the end wall 16 and has a width less than the end wall 16 to leave a narrow end wall portion or jamb 42. The exposed portion of the panel 22 beyond the jamb 42 forms a door stop for the access panel 40. The jamb 42 and door stop form a built-in frame for the access panel 40.

A hanger bar 44 of conventional design may be fitted into the container 10. Further details of the container 10, the hanger bar 44 and support thereof are shown and described in said copending application Serial No. 807,383 which is incorporated herein by reference.

The wardrobe container 10 preferably is formed from a one-piece blank 48 which is best illustrated in FIG. 2. The bottom wall 20 of the container 10 is formed from four bottom flaps 50, 52, 54 and 56 in a conventional manner. The bottom flaps, top flaps, the side walls and end walls, as well as the side flap 22, are connected along lines of fold 58. The access panel 40 is formed from the end wall 16 along a cut or perforation line 60. The cutout portions 28 and 30 are formed from their respective end flaps 24 and 26 along respective cut or perforation lines 62 and 64. The lines 60, 62 and 64 preferably are not completely cut so that the access panel 40 and the cutout portions 28 and 30 will stay in place until the container 10 is to be assembled.

The portions 28 and 30 have openings 66 and 68, in the panel sections 61 and 63, to which the hanger bar parts 46 are extendable. The access panel 40 may be opened along the perforation line 60 by grasping the top flap 36 and a lower cutout panel portion 71.

Figure 3:
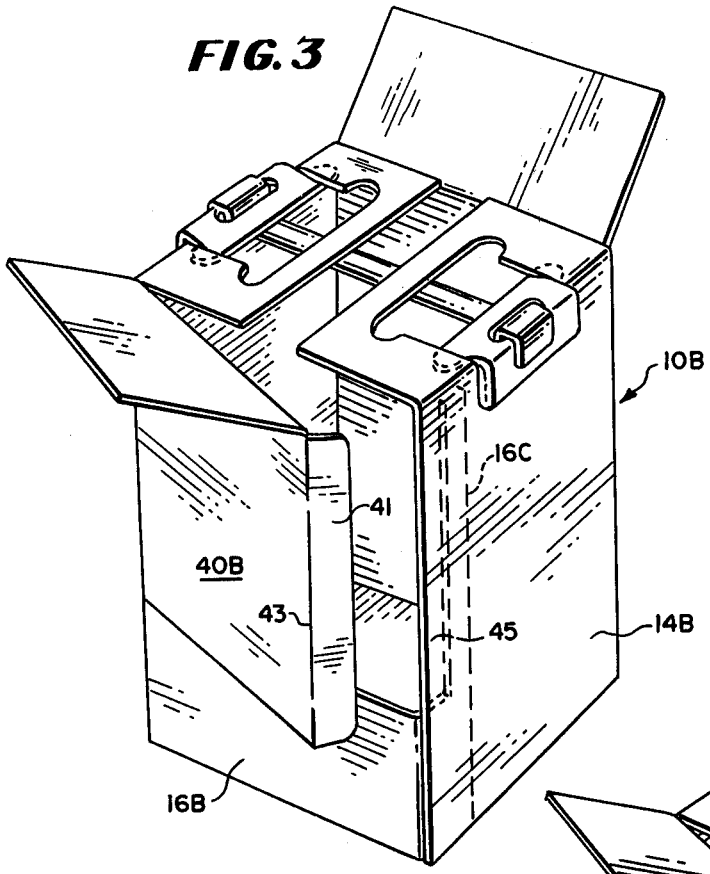
FIG. 3 is a perspective view of the container of FIG. 1 but having a second modified embodiment of access door means.

FIG. 3 illustrates a container 10B having a modified access panel 40B. Here, the panel or door 40B has an extension flap 41 extending from a line of fold 43. The wall portion 16B has an L-shaped extension flap 16C extending therefrom and secured to the inside surface of the side wall 14B. The flap 16C forms the jamb for the panel 40B when the panel is closed. The extension flap 41 is sized to engage against the extension flap or jamb 16C in mating edge engagement therewith and abutting an exposed portion 45 of the side wall 14B on the interior thereof. The portion 45 forms the door stop for the flap 41 of the panel 40B which may be adhesively secured thereto.

Figure 4:
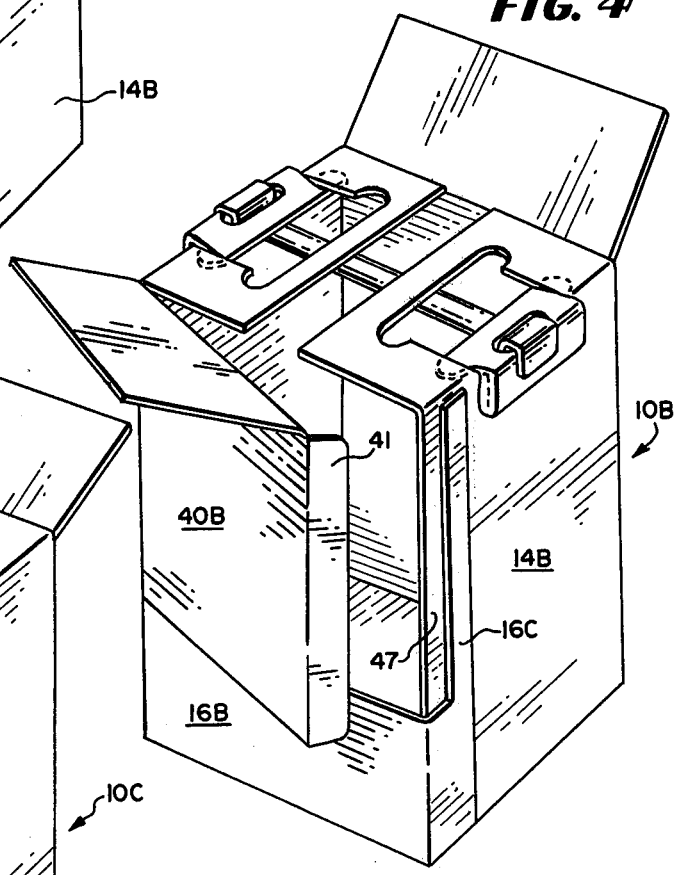
FIG. 4 is a perspective view of the wardrobe container of FIG. 3 but modified for providing another embodiment of access door means.

FIG. 4 shows the embodiment of FIG. 3, but with the extension flap or jamb 16C secured to the exterior of the wall 14B. The extension flap 41 will also abut an exterior exposed portion or door jamb 47 of the wall 14B.

Figure 5:
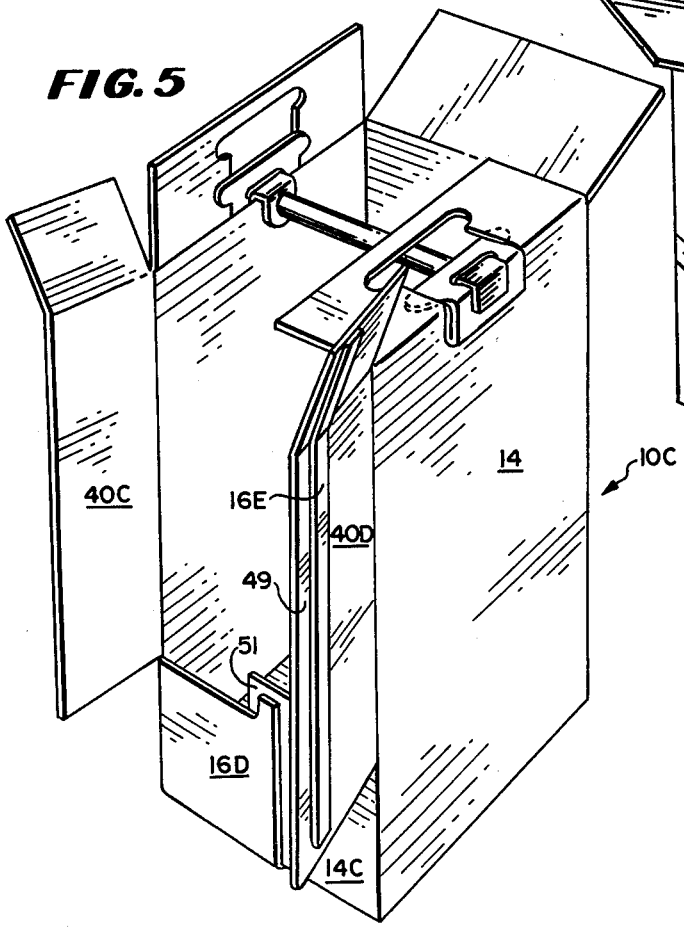
FIG. 5 is a view similar to FIG. 1 but showing another embodiment of access door means.

FIG. 5 illustrates a container 10C having a multipart embodiment of access panel having two portions 40C and 40D. The wall portion 16D has an extension or jamb 16E which is cut off and secured to the portion 40D. The exposed portion 49 of the exterior of the portion 40D forms the door jamb for the portion 40C. The interior edge of the portion 40C abuts an exposed corner 51 of the wall portion 14C and may be adhesively secured to the corner 51 and the door jamb 49. The portions may of course be reversed in their operation.

Figure 6:
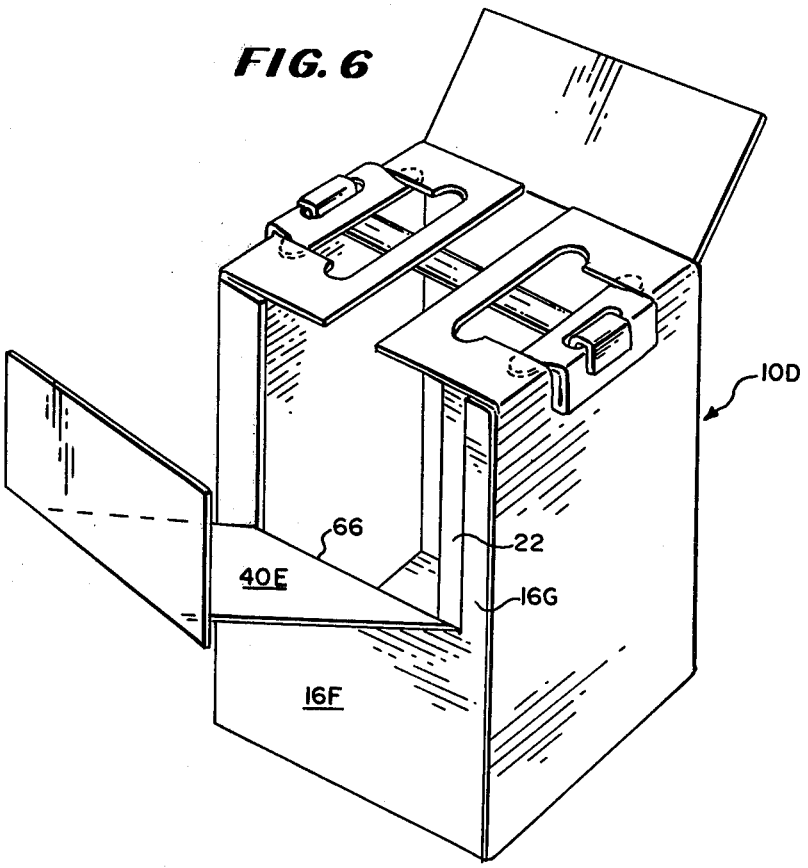
FIG. 6 is a perspective view similar to FIG. 1 but showing another embodiment of access door means.

FIG. 6 illustrates a wardrobe container 10D having an access panel 40E. The panel 40E is hingedly secured to the end wall portion 16F along a horizontal line of fold 66. An extension flap 16G forms a jamb for the panel 40E and is secured to panel 22. The exposed part of the panel 22 forms the door stop for the panel 40E.

Figure 7:
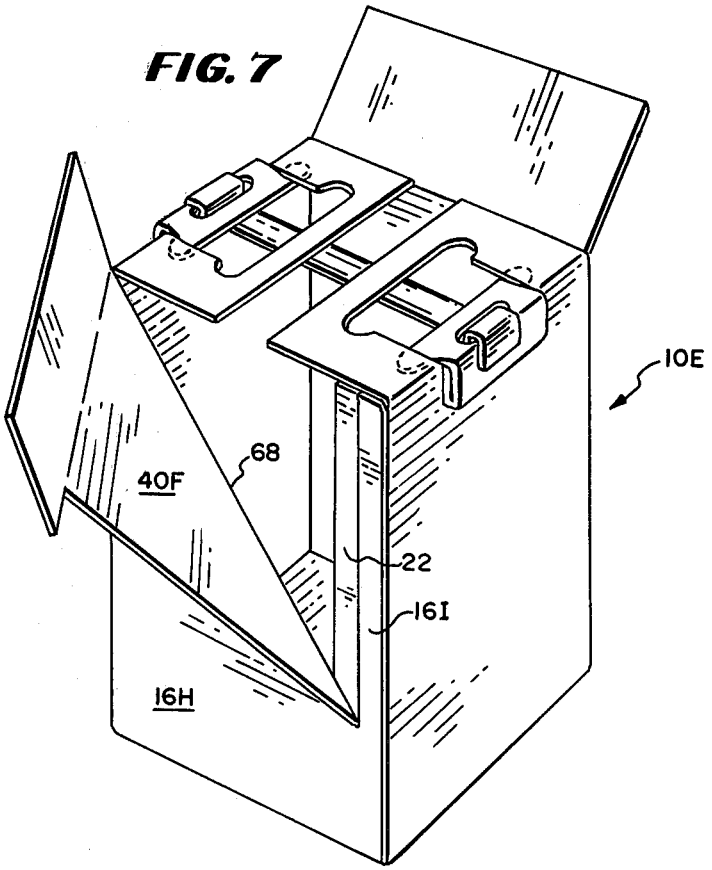
FIG. 7 is a perspective view similar to FIG. 6 but showing another embodiment of access door means.

FIG. 7 shows a container 10E including a modified embodiment of access panel 40F from that shown in FIG. 6. The panel 40F is hingedly secured to the end wall portion 16H along a diagonal line of fold 68. The extension flap 16I forms a jamb for the panel 40F in a like manner as the extension 16G.

It is to be understood that the invention contemplates implementation thereof in connection with other than the end wall 16. The hanger bar support means may be other than that shown or may be omitted if desired. The respective sizes illustrated are also illustrated as an example, and many other combinations of sizes of the walls and access panels and the corresponding assembled carton are possible within the scope of the invention.

What is desired to be secured by Letters Patent of the United States is:

1. An improved access door means for a storage or wardrobe container formed from a one-piece blank having at least two side walls, two end walls and a bottom connected together, said improved access door means comprising:

a first one of said walls (16, 16B, 16D, 16F, 16H including a hingedly mounted access door (40, 40B, 40C, 40E, 40F) allowing access into said container interior when opened, said door being formed from a portion of said first wall;

a jamb (42, 16C, 16E, 16G, 16I) connected to said first wall extending substantially the entire length of one edge of said access door and fixedly secured to said container adjacent said one edge of said access door when said door is closed; and an access door stop (22, 45, 47, 49) secured to and extending beyond said jamb substantially along the entire length thereof to form a support for said access door when said door is closed, said stop substantially in a plane parallel to the plane of at least a portion of said door but offset therefrom when said door is closed.

2. The improved access door as claimed in claim 1 wherein:

said access door (40) is hingedly connected to a second wall (12) along an edge thereof adjacent said first wall and is of a length less than the length of said second wall and of a width less than the width of said first wall, leaving said jamb (42) opposite said second wall hinged connection, said stop (22) being connected to a third wall (14) along an edge thereof and extending therefrom adjacent said jamb, said jamb being secured to said third wall extension.

3. The improved access door as claimed in claim 2 further including:

a top flap (36) hingedly connected along a top free edge of said access door and foldable over the top of said container when said access door is closed to completely seal said container.

4. The improved access door as claimed in claim 1 wherein:

said access door (40) is hingedly connected to a second wall (12) and is of a length less than said second wall and includes an extension flap (41) attached to the edge opposite said hinged connection to engage against said stop (45, 47), said stop being a portion of a third wall (14B) opposite said second wall hinged connection, and said jamb (16C) extending from said first wall and secured to said third wall beyond said stop portion.

5. The improved access door as claimed in claim 4 further including:

a top flap (36) hingedly connected along a top free edge of said access door and foldable over the top of said container when said access door is closed to completely seal said container.

6. The improved access door as claimed in claim 1 wherein:

said access door is formed from two overlapping portions (40C, 40D) each hingedly connected to a wall (12, 14) adjacent said first wall and of a length less than the length of said adjacent wall, and said access door is separated from a bottom wall portion (16D) of said first wall, said first wall bottom portion also being formed from two overlapping portions (16D, 14C), one of which includes said jamb (16E) separated from and secured to the access door overlapping portion (40D) opposite thereof to abut the other access door portion, said stop being formed by an exposed edge (49) of said overlapping portion secured to said jamb.

7. The improved access door as claimed in claim 6 further including:

a top flap (36) hingedly connected along a top free edge of said access door and foldable over the top of said container when said access door is closed to completely seal said container.

8. The improved access door as claimed in claim 1 wherein:

said access door (40E) is hingedly connected to a bottom portion (16F) of said first wall, said hinged connection (66) being substantially parallel to said container bottom and said door being of the length less than the length of said first wall and of a width less than the width of said first wall, leaving said jamb (16G) along one edge thereof, said stop (22) being connected to a second wall (14) along an edge thereof and extending therefrom adjacent said jamb, said jamb being secured to said second wall extension.

9. The improved access door as claimed in claim 8 further including:

a top flap (36) hingedly connected along a top free edge of said access door and foldable over the top of said container when said access door is closed to completely seal said container.

10. The improved access door as claimed in claim 1 wherein:

said access door (40F) is hingedly connected to said first wall (16H), said hinged connection (68) being formed on a diagonal from an upper edge of said first wall to a lower portion thereof and said door being of a length less than the length of said first wall and of a width less than the width of said first wall, leaving said jamb (16I) along one edge thereof, said stop (22) being connected to a second wall (14) along an edge thereof and extending therefrom adjacent said jamb, said jamb being secured to said second wall extension.

11. The improved access door as claimed in claim 10 further including:

a top flap (36) hingedly connected along a top free edge of said access door and foldable over the top of said container when said access door is closed to completely seal said container.

* * * * *